US009745883B2

(12) United States Patent
Quadri et al.

(10) Patent No.: US 9,745,883 B2
(45) Date of Patent: Aug. 29, 2017

(54) INCLINED PERFORATED PLATE AT RADIAL INLET

(71) Applicant: Faurecia Emissions Control Technologies, USA, LLC, Columbus, IN (US)

(72) Inventors: Syed Saleem Quadri, Bengaluri (IN); Yin Chen, Carmel, IN (US); Bogdan T. Kolodziej, Clarkston, MI (US); Michael Smith, Nashville, IN (US)

(73) Assignee: Faurecia Emissions Control Techhnologies, USA, LLC, Columbus, IN (US)

( * ) Notice: Subject to any disclaimer, the term of this patent is extended or adjusted under 35 U.S.C. 154(b) by 0 days.

(21) Appl. No.: 14/784,617

(22) PCT Filed: Apr. 16, 2013

(86) PCT No.: PCT/US2013/036706

§ 371 (c)(1),
(2) Date: Oct. 15, 2015

(87) PCT Pub. No.: WO2014/171923

PCT Pub. Date: Oct. 23, 2014

(65) Prior Publication Data

US 2016/0053657 A1 Feb. 25, 2016

(51) Int. Cl.

| | |
|---|---|
| ***F01N 13/08*** | (2010.01) |
| ***F01N 3/28*** | (2006.01) |
| ***F01N 3/035*** | (2006.01) |
| ***F01N 13/00*** | (2010.01) |

(52) U.S. Cl.

CPC ..... *F01N 13/08* (2013.01); *F01N 3/035* (2013.01); *F01N 3/28* (2013.01); *F01N 13/0097* (2014.06); *F01N 3/2892* (2013.01); *F01N 2240/20* (2013.01); *F01N 2470/18* (2013.01)

(58) Field of Classification Search

CPC ..... F01N 3/038; F01N 3/2892; F01N 2240/20
See application file for complete search history.

(56) References Cited

U.S. PATENT DOCUMENTS 8,814,969 B2 8/2014 Nagasaka et al.

FOREIGN PATENT DOCUMENTS

| | | | |
|---|---|---|---|
| EP | 2287453 | | 2/2011 |
| JP | 55142531 A | * | 11/1980 |
| JP | 2009013927 | | 1/2009 |
| JP | 2009216074 A | * | 9/2009 |

(Continued)

OTHER PUBLICATIONS

Machine translation of JP 2009216074 A, accessed Sep. 13, 2016.*

(Continued)

*Primary Examiner* — Jonathan Matthias
(74) *Attorney, Agent, or Firm* — Carlson, Gaskey & Olds, PC

(57) ABSTRACT

An exhaust component extends between a first end and a second end. The exhaust component defines an internal cavity with a central axis that extends from the first end to the second end. The exhaust component includes an inlet and an outlet, wherein the inlet extends transversely relative to the central axis. A perforated plate is positioned within the internal cavity at the inlet. The perforated plate extends obliquely relative to the center axis.

17 Claims, 2 Drawing Sheets

(56) References Cited

FOREIGN PATENT DOCUMENTS

| | | | |
|---|---|---|---|
| JP | 2010031719 A | * | 2/2010 |
| KR | 20110067248 | | 6/2011 |
| KR | 20110067248 A | * | 6/2011 |

OTHER PUBLICATIONS

Machine translation of JP 2010031719 A, accessed Sep. 13, 2016.*
Machine translation of KR 20110067248 A, accessed Sep. 13, 2016.*
Machine translation of JP 55142531 A, accessed Mar. 1, 2017.*
International Preliminary Report on Patentability for International Application No. PCT/US2013/036706 mailed Oct. 29, 2015.
Supp. EP Search Report dated Nov. 10, 2016.

* cited by examiner

INCLINED PERFORATED PLATE AT RADIAL INLET

TECHNICAL FIELD

The subject invention relates to an exhaust component that has an inclined perforated plate at a radial inlet.

BACKGROUND OF THE INVENTION

Exhaust systems are widely known and used with combustion engines. Typically, an exhaust system includes exhaust tubes or pipes that convey hot exhaust gases from the engine to other exhaust system components, such as mufflers, converters, resonators, etc. As known, a catalytic converter converts toxic by-products of the exhaust gases to less toxic substances by way of catalysed chemical reactions. The catalytic converter includes a substrate positioned within a housing that has an exhaust gas inlet and an exhaust gas outlet. As the exhaust gas flows through the substrate, pollutants such as carbon monoxide, unburned hydrocarbon, and oxides of nitrogen are converted to less toxic substances such as carbon dioxide and water, for example.

In one known configuration, a perforated plate is positioned upstream of the catalytic converter such the plate is parallel to an end face of the substrate. The plate is used to improve a uniform flow distribution and to increase emission conversion efficiency. While these plates have proved effective, there is always a need to further increase emission conversion efficiency.

SUMMARY OF THE INVENTION

In one example embodiment, an exhaust component extends between a first end and a second end. The exhaust component defines an internal cavity with a central axis that extends from the first end to the second end. The exhaust component includes an inlet and an outlet, wherein the inlet extends transversely relative to the central axis. A perforated plate is positioned within the internal cavity at the inlet. The perforated plate extends obliquely relative to the center axis.

In a further embodiment of the above, the inlet extends radially outwardly relative to the central axis from a side surface of the exhaust component.

In a further embodiment of any of the above, the outlet extends radially outwardly relative to the central axis from a side surface of the exhaust component.

In a further embodiment of any of the above, the outlet extends axially outward from an end face of the second end of the exhaust component in a direction along the central axis.

In a further embodiment of any of the above, the inlet defines an inlet axis that intersects the central axis, and wherein the perforated plate is obliquely orientated relative to the inlet axis.

In a further embodiment of any of the above, the perforated plate comprises a generally flat plate body including a plurality of holes, and wherein the plate body has an upstream surface that faces the inlet.

In a further embodiment of any of the above, the exhaust component comprises a catalytic converter.

In another exemplary embodiment, a vehicle exhaust system includes a catalytic converter having an outer peripheral surface extending between a first end and a second end. The catalytic converter defines an internal cavity with a central axis that extends from the first end to the second end. A substrate is positioned within the internal cavity. An inlet to the catalytic converter defines an inlet axis that intersects the central axis. A perforated plate is positioned within the internal cavity at the inlet, with the perforated plate extending obliquely relative to the center axis.

DETAILED DESCRIPTION

Figure 1:
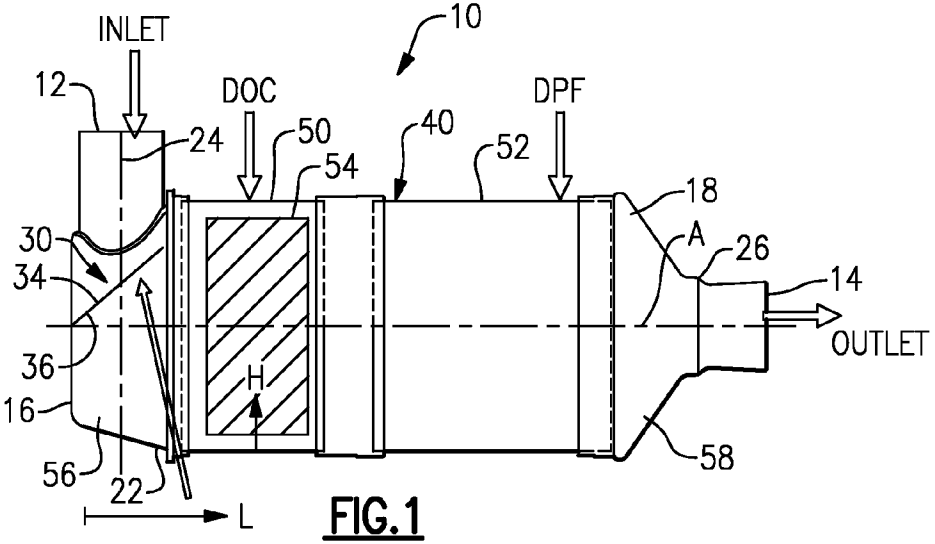
FIG. 1 is a side view of an exhaust component assembly incorporating the subject invention.
Figure 2:
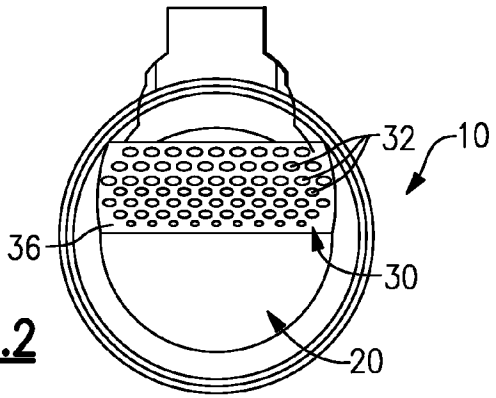
FIG. 2 is a section end view of the exhaust component assembly of FIG. 1.

FIG. 1 shows an exhaust component assembly 10 for a vehicle exhaust system. The exhaust component assembly 10 includes an inlet 12 that receives exhaust gases from a vehicle engine and an outlet 14 that directs the exhaust gases to a downstream exhaust component, such as a tailpipe for example. The exhaust component assembly 10 extends between a first end 16 and a second end 18 and defines an internal cavity 20 as shown in FIG. 2. The exhaust component assembly 10 is defined by a central axis A that extends from the first end 16 to the second end 18.

The inlet 12 is at the first end 16 of the exhaust component assembly 10 and the outlet 14 is at the second end 18 of the exhaust component assembly 10. The inlet 12 extends transversely to the central axis A. In the example shown in FIG. 1, the inlet 12 comprises a radial inlet configuration where the inlet 12 extends radially outwardly relative to the central axis A from a circumferential side surface 22 of the exhaust component assembly 10. In one example, the inlet defines an inlet axis 24 that intersects the central axis A at a ninety degree angle.

Figure 4:
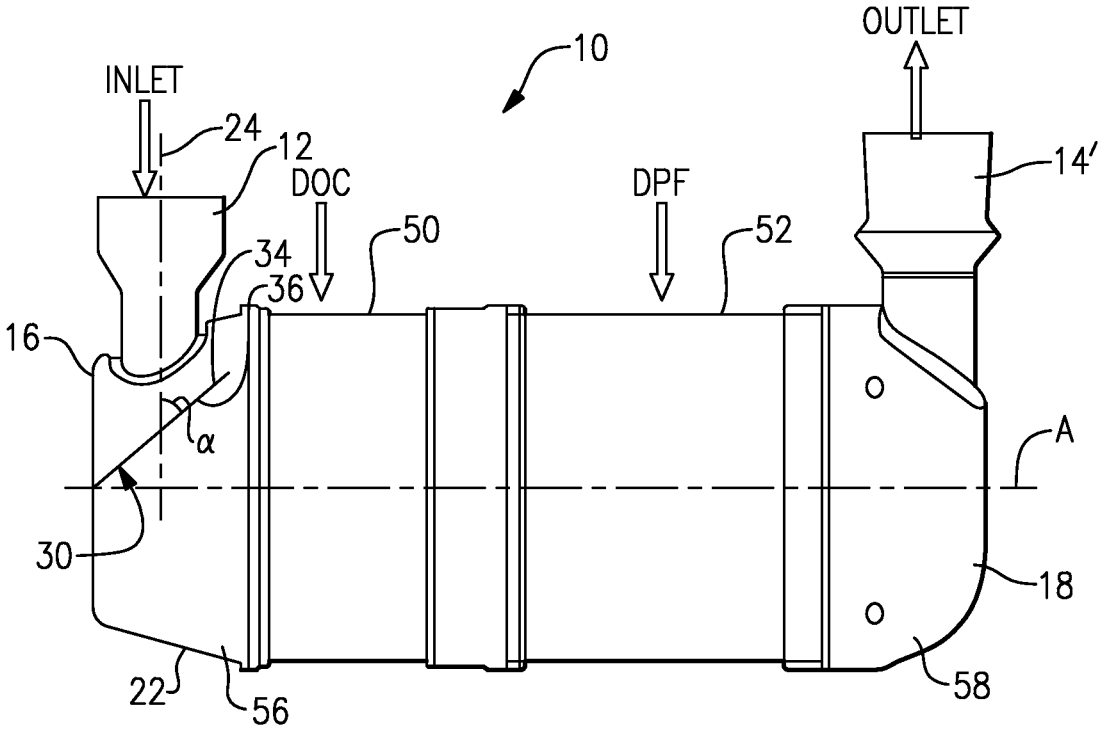
FIG. 4 is another example of an exhaust component assembly incorporating the subject invention.

In the example in FIG. 1, the outlet 14 comprises an axial outlet configuration where the outlet 14 extends axially outward from an end face 26 of the second end 18 of the exhaust component assembly 10 in a direction along the central axis A. In the example shown in FIG. 4, an outlet 14' comprises a radial outlet configuration where the outlet 14' extends radially outwardly relative to the central axis A from the side surface 22 of the exhaust component assembly 10. The outlet 14' can extend radially outwardly from the side surface 22 in the same direction as the inlet 12 or from other directions depending upon vehicle application and packaging constraints.

In each configuration, a perforated plate 30 is positioned within the internal cavity 20 at the inlet 12. The perforated plate 30 is positioned to extend obliquely, i.e. non-parallel and non-perpendicular, relative to the center axis A. As discussed above, the inlet 12 defines the inlet axis 24, which intersects the central axis A. The perforated plate 30 is obliquely orientated relative to the inlet axis 24.

In one example, the inlet axis 24 and central axis A intersect at a right angle. In one example mounting arrangement, the perforated plate 30 intersects the inlet axis 24 at an angle $\alpha$ of 50 degrees. However, the perforated plate could be oriented with a range of angles $\alpha$ from 45 degrees to 55 degrees. The range of angles $\alpha$ could also be as great as 10 degrees to 80 degrees. Additionally, the position of the plate 30 could be moved to different axial locations along the inlet axis 24 as needed to improve distribution.

Figure 3:
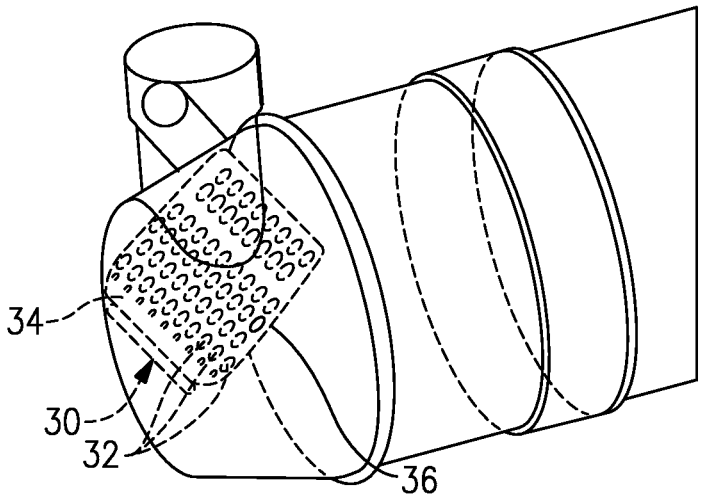
FIG. 3 is a perspective view of FIG. 2.

As shown in FIG. 3, the perforated plate 30 comprises a generally flat plate body including a plurality of holes 32. The plate body has an upstream surface 34 that faces the inlet 12 and a downstream surface 36 that faces inward toward the internal cavity 20. The plate 30 is defined by a thickness that extends between the upstream surface 34 and the downstream surface 36. In the example shown, the holes 32 extend entirely through the thickness. Further, the holes 32 are dispersed across the entire length and height of the plate 30. As shown, the holes 32 are arranged in a pattern of rows; however, other patterns could also be used.

The exhaust component assembly 10 is comprised of an outer shell 40 that extends circumferentially around the central axis A. The outer shell 40 can be comprised of a single-piece structure, or can be comprised of a plurality of pieces that are attached to each other to form the outer shell 40. The outer shell 40 defines the internal cavity 20, which has a length L extending along the central axis A and a height H extending perpendicular to the central axis A. The perforated plate 30 is located within the internal cavity 20 such that the plate 30 does not completely extend across the height H of the internal cavity 20. In the example shown, the plate 30 is positioned in an upper portion of the cavity 20, i.e. the portion above the central axis A, and does not extend downwardly into a lower portion, i.e. the portion below the central axis A.

The exhaust component assembly 10 is comprised of a plurality of individual components that are attached to each other to form the exhaust component assembly 10. In the examples shown in FIGS. 1 and 4, the exhaust component assembly 10 includes a catalytic converter 50, such as a diesel oxidation catalyst (DOC), for example, and a diesel particulate filter (DPF) 52. The catalytic converter 50 includes a substrate shown schematically at 54 that is positioned within the internal cavity 20, and the DPF 52 is positioned downstream of the substrate 54. The inlet 12 and perforated plate 30 are positioned upstream of the substrate 54.

First 56 and second 58 end caps are respectively installed at the first end 16 and second end 18 of the exhaust component assembly 10 to enclose the internal cavity 20. The first end cap 56 is attached to an upstream end of the catalytic converter 50 and the second end cap 58 is attached to a downstream end of the DPF 52. In one example, the inlet 12 is attached to the first end cap 56 and the outlet 14, 14' is attached to the second end cap 58.

Exhaust gases flow in a radially inward direction through the inlet 12, where they hit the upstream surface 34 of the inclined perforated plate 30. The plate 30 is positioned immediately adjacent the inlet 12 such that substantially all of the exhaust gases are directed toward the plate 30 upon entering the internal cavity 20. The exhaust gas passes through the holes 32 and enters the substrate 54 where the contaminant conversion takes place. The gases then pass into the DPF 52 and then exit the outlet 14, 14'.

Figure 6:
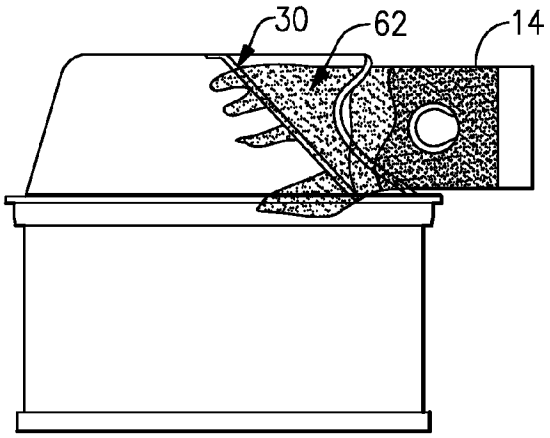
FIG. 6 shows exhaust gas distribution for an inclined plate configuration such as that of FIGS. 1-4.
Figure 5:
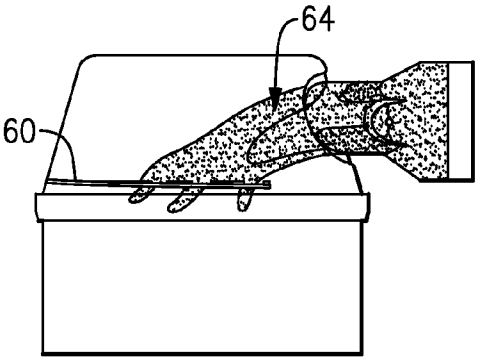
FIG.5 Prior Art
FIG. 5 shows exhaust gas distribution for a prior art configuration with a parallel plate.

The inclined perforated plate 30 improves the uniform distribution of the exhaust gases for a radial inlet configuration for a catalytic converter as compared to a configuration that uses a parallel plate 60 as shown in FIG. 5. By using the inclined perforated plate 30, the distribution of exhaust gases (indicated at 62 in FIG. 6) entering the catalytic converter 50 has improved significantly as compared to the distribution (indicated at 64 in FIG. 5) for the parallel plate orientation.

Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A vehicle exhaust system comprising:

an exhaust component extending between a first end and a second end, the exhaust component comprising an outer shell defining an internal cavity with a central axis that extends from the first end to the second end, and wherein the internal cavity is defined by a length extending along the central axis and a height extending perpendicular to the central axis;

an inlet to the exhaust component, the inlet comprising an inlet tube defining an inlet axis extending transversely to the central axis;

an outlet from the exhaust component; and a perforated plate positioned within the internal cavity of the outer shell downstream from the inlet tube, the perforated plate extending obliquely relative to the central axis, and wherein the perforated plate comprises a flat plate body including a plurality of holes, and wherein the plate body has an upstream surface that faces an outlet from the inlet tube, and wherein the plate body is positioned within the outer shell such that the plate body does not completely extend across the height of the internal cavity.

2. The vehicle exhaust system according to claim 1, wherein the inlet is at the first end of the exhaust component and the outlet is at the second end of the exhaust component.

3. The vehicle exhaust system according to claim 2, wherein the inlet tube extends radially outwardly relative to the central axis from a side surface of the exhaust component, and wherein the outlet comprises an outlet tube that extends radially outwardly relative to the central axis from a side surface of the exhaust component or extends axially outward from an end face of the second end of the exhaust component in a direction along the central axis.

4. The vehicle exhaust system according to claim 2, wherein the outlet comprises an outlet tube that extends radially outwardly relative to the central axis from a side surface of the exhaust component.

5. The vehicle exhaust system according to claim 2, wherein the outlet comprises an outlet tube that extends axially outward from an end face of the second end of the exhaust component in a direction along the central axis.

6. The vehicle exhaust system according to claim 1, wherein the inlet axis intersects the central axis, and wherein the perforated plate is obliquely orientated relative to the inlet axis.

7. The vehicle exhaust system according to claim 6, wherein the inlet axis and central axis intersect at a right angle.

8. The vehicle exhaust system according to claim 1, wherein the exhaust component comprises a catalytic converter with a substrate positioned within the internal cavity, and wherein the inlet and perforated plate are positioned upstream of the substrate.

9. The vehicle exhaust system according to claim 8, wherein the inlet tube extends radially outwardly relative to the central axis from a side surface of the catalytic converter.

10. The vehicle exhaust system according to claim 9, wherein the inlet axis intersects the central axis, and wherein the perforated plate is obliquely orientated relative to the inlet axis.

11. The vehicle exhaust system according to claim 10, wherein the perforated plate comprises a flat plate body including a plurality of holes, and wherein the plate body has an upstream surface that faces an outlet from the inlet tube.

12. The vehicle exhaust system according to claim 1, wherein the outer shell further includes a first end cap enclosing the internal cavity at the first end and a second end cap enclosing the internal cavity at the second end, and wherein the perforated plate is positioned within the first end cap.

13. A vehicle exhaust system comprising:

a catalytic converter having an outer shell with an outer peripheral surface extending between a first end and a second end, the outer shell defining an internal cavity with a central axis that extends from the first end to the second end, and wherein the internal cavity is defined by a length extending along the central axis and a height extending perpendicular to the central axis;

a substrate positioned within the internal cavity;

an inlet to the catalytic converter, the inlet comprising a tube defining an inlet axis that intersects the central axis;

an outlet from the catalytic converter; and a perforated plate positioned within the internal cavity of the outer shell downstream from the inlet tube, the perforated plate extending obliquely relative to the center axis, and wherein the perforated plate comprises a flat plate body including a plurality of holes, and wherein the plate body has an upstream surface that faces an outlet from the inlet tube, and wherein the plate body is positioned within the outer shell such that the plate body does not completely extend across the height of the internal cavity.

14. The vehicle exhaust system according to claim 13, wherein the inlet axis and central axis intersect at a right angle.

15. The vehicle exhaust system according to claim 13, wherein the inlet tube extends radially outwardly relative to the central axis from the outer peripheral surface of the catalytic converter.

16. The vehicle exhaust system according to claim 13, including a diesel particulate filter immediately downstream of the catalytic converter.

17. The vehicle exhaust system according to claim 13, wherein the outer shell further includes a first end cap enclosing the internal cavity at the first end and a second end cap enclosing the internal cavity at the second end, and wherein the perforated plate is positioned within the first end cap.

* * * * *